United States Patent [19]

Biedermann et al.

[11] 4,365,902

[45] Dec. 28, 1982

[54] WIRE MATRIX PRINT HEAD

[75] Inventors: Horst H. Biedermann, Augsburg; Ferdinand Hermann, Neuaess; Ernst Pechinger, Meitingen; Emil L. F. Sereinigg, Augsburg, all of Fed. Rep. of Germany

[73] Assignee: NCR Corporation, Dayton, Ohio

[21] Appl. No.: 276,440

[22] Filed: Jun. 22, 1981

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,897,865 | 8/1975 | Darwin et al. | 400/124 |
| 4,084,678 | 4/1978 | Reier et al. | 400/124 |
| 4,185,929 | 1/1980 | Hebert | 400/124 |
| 4,236,836 | 12/1980 | Hodne | 400/124 |
| 4,309,116 | 1/1982 | Maeda | 400/124 |

FOREIGN PATENT DOCUMENTS

| | | | |
|---|---|---|---|
| 2816096 | 10/1978 | Fed. Rep. of Germany | 400/124 |

*Primary Examiner*—Paul T. Sewell

*Attorney, Agent, or Firm*—J. T. Cavender; Edward Dugas; Donald P. Gillette

[57] ABSTRACT

A multiwired print head having an elongated conical center member with wire guiding sections formed thereon and with a plurality of recessed portions for minimizing the surface contact area between the print wire and the elongated member. In addition, the elongated member mounted within a frame having actuators operating therewith for imparting axial motion to the print wires and having wire bridge supports for supporting the elongated conical member to the frame at positions corresponding to the raised portions of the conical member which bridge members act to retain the print wires in their recessed notches.

2 Claims, 5 Drawing Figures

WIRE MATRIX PRINT HEAD

BACKGROUND OF THE INVENTION

In the field of high-speed printing devices which are especially suitable for use in connection with electronic data processing systems, the wire matrix type of printer has come into increasing use. In this type of printer, letters, numbers and symbols are formed from a series of dots produced by the impact of the head of a plurality of wire elements on a record media. Interposed between the wire elements and the record media customarily is an ink ribbon which provides the ink needed to produce a mark on the record medium being printed upon. In addition, in the past the number of wires has generally been restricted to the range of seven through nine. As the art advances, an obvious need for increased numbers of wires, for example 18 wires, arises so that variation of symbols and better quality of letters and numbers may be printed.

One problem which has arisen in connection with the use of wire printers is that of fatigue breakage of the print wires which breakage is caused by the bending and vibration of the print wires under the high force employed to drive the wires over a short distance to impact upon the record medium. This vibration may be in a multimode direction, that is transverse to the length of the wire. In order to reduce or eliminate such breakage in some prior art structures the individual print wires have been confined within print head blocks or units, or within tubes or coil springs anchored in the printer framework. These structures have the disadvantages of increasing the parts and labor costs, and also tend to impede the movement of the printer wires by frictional engagement between the wires and the tubes. In U.S. Pat. No. 4,081,067 entitled "Internal Vibration Dampening Means For Printing Mechanism" by R. L. Schrag et al. there is disclosed a wire dampening mechanism formed as a conical elongated unit inserted into the central area of the wire print head with the wires positioned around the periphery thereof. Wire bending is thus restricted when the wire deflects sufficiently to come into contact with the outer surface of the conical element.

Another prior art device of interest is disclosed in U.S. Pat. No. 3,897,865 entitled "Dot Printing Apparatus" by D. P. Darwin et al. The wire print head disclosed in that patent is comprised of an inner central cone having longitudinal slots along the outer surface thereof to receive and guide the print wires and a second cone positioned over the first inner cone to encase the inner cone and the wires. The wires of the print head thus have a continuous guide support for each individual wire from the input to a point at which they are positioned parallel and nearly colinear at the output end of the printer. Two features claimed for the print head are (1) that the print head is easier to construct, and (2) that the paths of the individual wires are equal and that the ends of the wires are parallel at the output instead of convergent.

Another patent of interest is U.S. Pat. No. 4,004,671 entitled "Wire Matrix Print Head" by N. Kondur, Jr. In the print head of the reference there is provided a generally conical, slotted wire guide body which converges forwardly into a hollow head and terminates in a bearing portion at its leading end. The bearing portion defines a series of vertically aligned, closely spaced openings for reception of the leading ends of the print wires.

The slots in the conical body generally conform in width to the diameter of the cross-sectional size of a print wire. Each slot varies in depth along its length, and each slot is of a slightly different depth to permit its respective print wire to be disposed to extend along its elastic curve.

SUMMARY OF THE INVENTION

This invention relates to a printer of the matrix type, and more particularly relates to a printer which includes a structure for minimizing the vibration and bending of the print wires and to facilitate the assembly of the print head.

In accordance with one embodiment of the invention, there is provided a rigid frame member having an elongated conical section supported by the support member. The conical member is provided with recesses along the longitudinal axis thereof for accepting a plurality of print wires. A number of recessed areas circumscribing the conical member are provided so as to avoid contact with the print wires. A driving apparatus is operatively connected to the frame member for axially driving each of the print wires. An end member having a centrally disposed flat spacer is positioned to divide the print wires along two parallel axes. At least two wire guide bridges encircle the elongated conical member and retaining the print wires within their respective slots.

One advantage of the present invention is that bending of the print wires is minimized without exceptional frictional drag on the wires since the wires are, in the worst case, only in contact with limited surfaces on either the guide bridge or the elongated conical section.

Another decided advantage of the present invention is in the assembly thereof where a large number of wires have to be positioned in the print head, the outer wire bridge guides, cooperating with the slots in the elongated conical member, provide a path for insertion of and retention of the wires. It is a further object of the present invention to provide a print head which is inherently self-cleaning, having the ability to automatically divest itself of fine dust and dirt particles that collect in the print head during operation.

These advantages and others will become more apparent when taken in conjunction with the following description and drawings wherein like characters indicate like parts and which drawings form a part of the present disclosure.

DESCRIPTION OF THE PREFERRED EMBODIMENT

Figure 1:
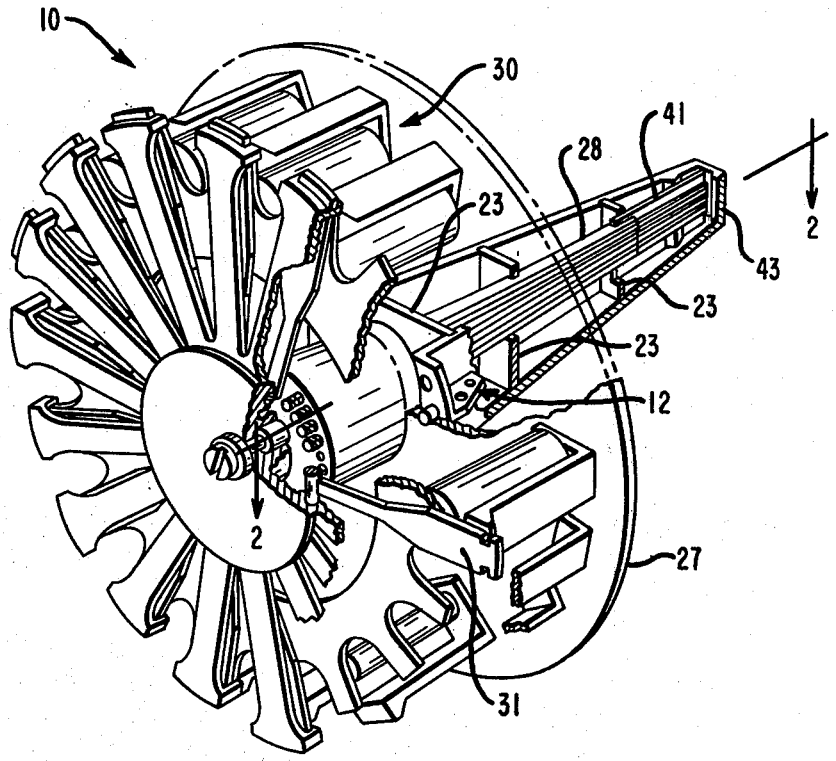
FIG. 1 is a partially cutaway perspective view of the wire matrix print head of the present invention.
Figure 2:
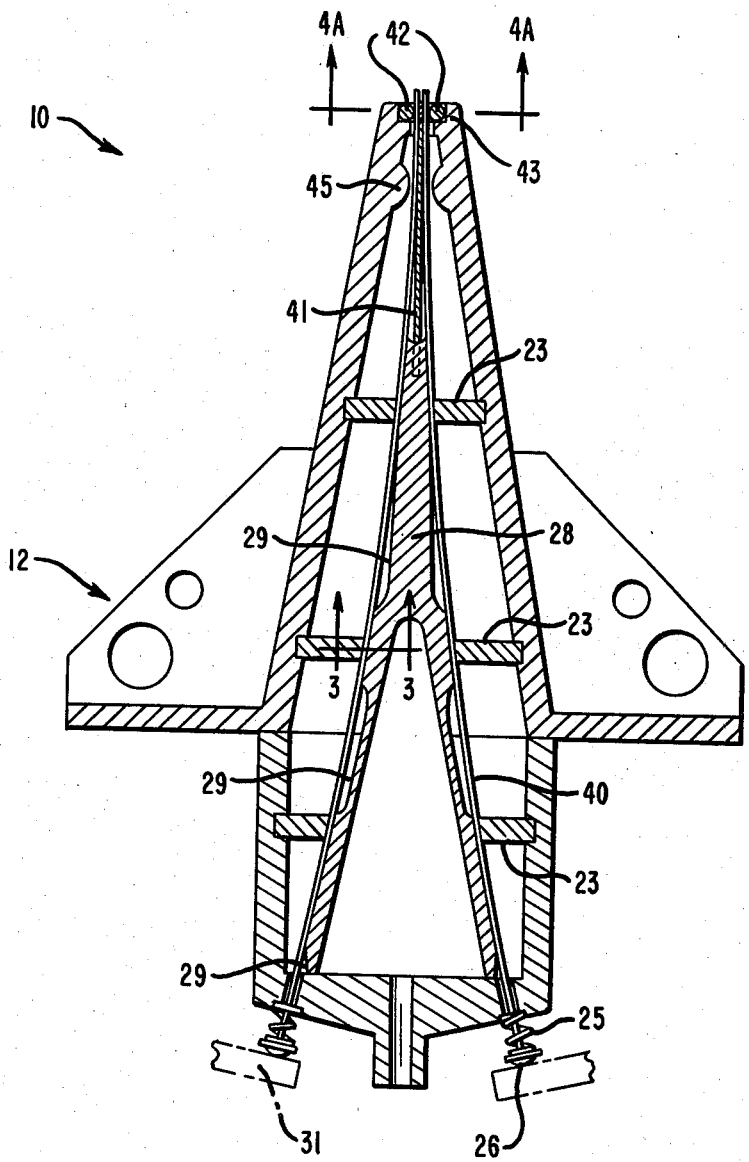
FIG. 2 is a section view of a portion of the wire matrix print head of FIG. 1.

Referring now particularly to FIGS. 1 and 2, a wire matrix print head 10 is shown. A rigid frame 12 supports a plurality of wire guide bridges 23. An elongated conical member 28 snugly fits into each of the wire guide bridges 23. Surfaces 29 of the conical member intermediate the wire guide bridges are recessed to eliminate contact with the print wires 40. Each of the print wires 40 has a cap 26 affixed to the impact end. The cap may be made of plastic or other suitable material. Each wire also has affixed to the end next to the cap a spring element 25 for returning the wire to the non-impact position. A circular base 27 is fixed to the rigid support frame 12 and affixed thereto are a plurality of electromagnetic actuators 30 corresponding in number to the number of print wires. Each actuator is coupled to an impact arm 31. Extending axially from the conical shaped member 28 is a rectangular separation board 41. The board extends substantially to the end face 43. At the print wire end of the support member 12 there are two projections 45 extending from the frame member inwards towards the print wires 40. The projections are positioned so as not to contact the print wires unless the wires are deflected under impact pressure or unless the wires are in an oscillating mode. The projections are positioned close enough to the wires to prevent degredation of the impact print on the printing medium. A set of guides 42, more clearly shown in FIGS. 4A and 4B, made from a hard, smooth substance such as a ruby rod, is used to provide a minimum friction guide for the wires 40.

Figure 3:
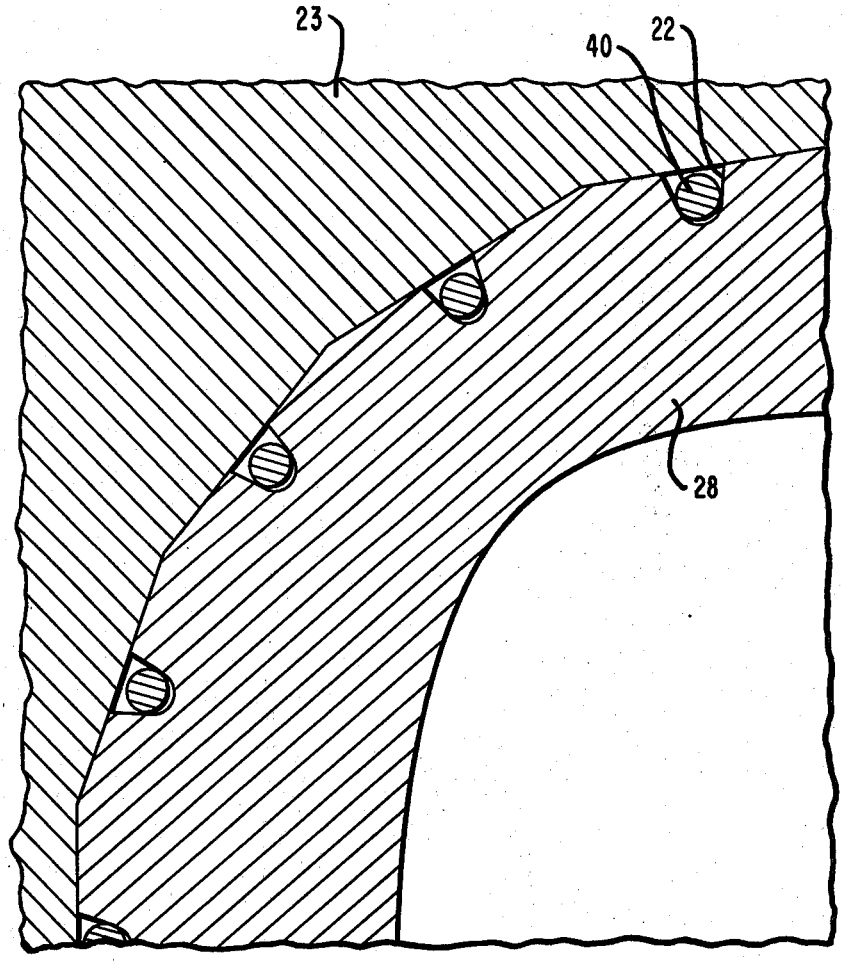
FIG. 3 is a partial cut away section view showing one quadrant of the wire matrix print head taken along the section lines designated 3—3 of FIG. 2.

Referring now to FIG. 3, the elongated central member 28 is shown having a plurality of recesses 22 therein for accepting the print wires 40. Around the outer periphery of the elongated central member is the wire bridge support 23 which snugly fits over the central member 28 and caps off the recesses 22. The notch 22 and the bridge support member 23 restrain the print wire 40 in the immediate proximity of the groove 22.

Figure 4B:
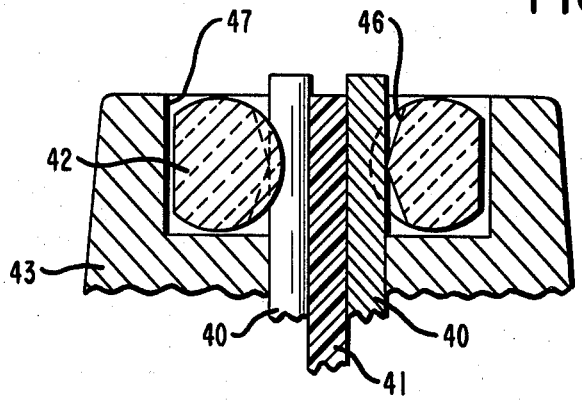
FIGS. 4A and 4B are section views of the end of the wire matrix print head taken along the section lines 4A—4A and 4B—4B respectively.
Figure 4A:
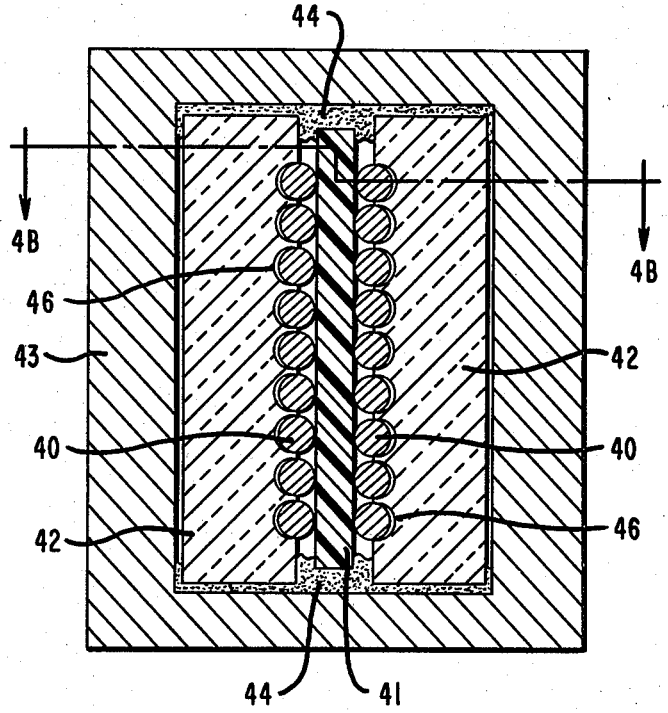

Referring now to FIG. 4A in conjunction with FIG. 4B, the end member 43 is shown with a recessed area 47 into which is positioned two semicylindrical ruby elements 42 along with the substantially rectangular separator 41. The ruby elements have a number of grooves 46 corresponding to the number of print wires 40. In the preferred construction, the ruby cylinders are held within the recess utilizing a cement 44. The grooves 46 are constructed so as to minimize the frictional force encountered by the print wires 40 in their transverse movement. In FIG. 4B the construction of the groove 46 can more clearly be seen as having a peak which provides a limited contact with to the print wire 40.

From the foregoing discussion, it can be seen that the construction of the present multiwired print head provides a minimum surface contact of the supporting elements with the print wires while still providing a degree of guidance for the print wires so as to minimize bending and oscillation. The construction also provides a structure which may be fabricated utilizing injection molding techniques to decrease the cost of components while also providing a guiding structure which, in the assembly phase, facilitates the insertion and positioning of the multi wires within the print head structure so as to speed up assembly.

Although the invention has been described and illustrated in detail, it is to be clearly understood that the same is by way of illustration and example only and is not to be taken by way of limitation, the spirit and scope of this invention being limited only by the terms of the appended claims.

We claim:

1. A wire print head comprising:

an elongated, tapered, central member having a plurality of recessed portions spaced longitudinally along the outer surface thereof;

a plurality of relatively laterally outwardly extending portions spaced longitudinally along the outer surface of the tapered, central member, the recessed portions alternating with the outwardly extending portions along the central member, and each of the relatively outwardly extending portions having a plurality of laterally open longitudinal grooves extending therealong and aligned with corresponding laterally open longitudinal grooves of at least one other of the laterally extending portions;

a plurality of print wires, each of the print wires being positioned in a set of the aligned grooves in the laterally outwardly extending portions, each of the sets of aligned grooves defining a substantially planar curve;

a plurality of print wire bridge members spaced apart longitudinally along the elongated, tapered, central member, each of the bridge members being opposite one of the laterally outwardly extending portions, respectively, and comprising a cap across the laterally open grooves in the respective laterally outwardly extending portion for retaining each of the print wires easily slidable within its respective groove in the respective laterally outwardly extending portion;

means for imparting axial movement to selected ones of the print wires to effect printing, each of said wires having a printing end and an opposite end, the printing ends of the wires being located in two closely spaced parallel rows and the opposite ends of the wires being spaced outwardly and apart from each other, each of the sets of laterally open longitudinal grooves accommodating one of the print wires being located to be along a planar curve between the print end of the wires and the opposite end thereof;

a thin, substantially flat spacer positioned between the two parallel rows close to the print end of the wires to maintain the two rows substantially parallel to each other; and wire guide means positioned on opposite sides of the parallel rows to maintain the wires in each of the rows in a fixed, laterally spaced relationship.

2. The wire print head according to claim 1 and further comprising:

a frame for supporting said wire print head; and projections on said frame in proximity to said parallel positioned print wires for limiting the buckling of said print wires in a direction away from said thin flat spacer.

* * * * *